US006308767B1

(12) United States Patent
Hugo et al.

(10) Patent No.: US 6,308,767 B1
(45) Date of Patent: Oct. 30, 2001

(54) LIQUID METAL BATH FURNACE AND CASTING METHOD

(75) Inventors: Franz Waldemar Ernst Hugo, Assaha Surg; Ulrich Betz, Hasselroth; Helmut Mayer, Erlensee, all of (DE)

(73) Assignees: General Electric Company, Schnenectady, NY (US); ALD Vacuum Technologies, Erlansee (DE)

( * ) Notice: Subject to any disclaimer, the term of this patent is extended or adjusted under 35 U.S.C. 154(b) by 0 days.

(21) Appl. No.: 09/469,035

(22) Filed: Dec. 21, 1999

(51) Int. Cl.[7] ..... B22D 27/04

(52) U.S. Cl. ..... 164/122.1; 164/338.1; 164/154.1

(58) Field of Search ..... 164/122.1, 122.2, 164/338.1, 150.1, 151.3, 154.1, 155.2, 155.4; 266/94

(56) References Cited

U.S. PATENT DOCUMENTS

| | | | | |
|---|---|---|---|---|
| 3,763,926 | * | 10/1973 | Tschinkel et al. | 164/338 |
| 3,897,815 | * | 8/1975 | Smashey | 164/127 |
| 4,108,236 | | 8/1978 | Salkeld | 164/338 R |
| 4,175,609 | | 11/1979 | El Gammal et al. | 164/60 |
| 4,178,986 | * | 12/1979 | Smashey | 164/251 |
| 4,750,541 | * | 6/1988 | Reuter et al. | 164/412 |
| 5,197,531 | * | 3/1993 | Hugo et al. | 164/122.1 |
| 5,298,887 | * | 3/1994 | Pepping | 340/618 |
| 5,339,885 | * | 8/1994 | Sinden et al. | 164/450.4 |
| 5,988,257 | * | 11/1999 | Hugo | 164/122.1 |
| 6,003,587 | * | 12/1999 | Mitsuhashi | 164/122.1 |
| 6,085,827 | * | 7/2000 | Hugo | 164/122.1 |

FOREIGN PATENT DOCUMENTS

631832A1 7/1993 (EP) .

OTHER PUBLICATIONS

English language abstract for 631832A1.

* cited by examiner

*Primary Examiner*—M. Alexandra Elve
*Assistant Examiner*—Kevin P. Kerns
(74) *Attorney, Agent, or Firm*—Paul J. DiConza; Donald S. Ingraham

(57) ABSTRACT

In a casting furnace employing a liquid metal bath to allow directional solidification of an article from a melt, and a method of operating such a furnace, a system is provided for lowering the mold from within a heating chamber into a liquid metal bath situated immediately beneath the heating chamber. An automated system is provided for automatically maintaining the level of the liquid metal bath at a relatively constant position immediately beneath the heating chamber, wherein simultaneously upon the level of the bath having risen due to immersion of the mold within the bath, the bath is lowered to thereby permit the level of the liquid metal bath to be maintained in a substantially fixed position.

8 Claims, 7 Drawing Sheets

LIQUID METAL BATH FURNACE AND CASTING METHOD

FIELD OF THE INVENTION

The present invention relates generally to casting of metals, and more specifically, relates to a metal bath furnace used in the directed solidification of superalloys, and a method for carrying out the casting of superalloys using directional solidification.

BACKGROUND OF THE INVENTION

Certain components, such as for example turbine blades and stator vanes for gas turbine engines, because of their relatively complex shapes and harsh operating environment to which these components are composed, are typically cast of nickel-based and cobalt-based alloys which are conventionally known as superalloys, which have high strength and typically very high melting temperatures.

The strength of such components is enhanced by forming the turbine vanes (stators), and particularly the turbine blades, using directional solidification casting for obtaining substantially single crystal components. Such a process is conventionally known.

Various processes and apparatus for directional solidification casting, such as directional solidification casting apparatus and method disclosed in U.S. Pat. Nos. 4,108,236 and 4,175,609, are known in the industry and vary in effectiveness. In these processes, a suitable ceramic mold is specifically configured for the particular component being cast, such as a gas turbine engine blade or vane. The mold is lowered into a heating chamber where it is preheated, and subsequently then filled with a desired superalloy in a superheated liquid melt condition. Thereafter, the bottom of the mold is then subjected to preferential cooling to commence the unidirectional solidification process necessary for single crystal formation, which travels upwardly through the mold.

Cooling of the mold may be accomplished in different manners. In one conventional process, a suitable liquid metal coolant, such as molten tin or aluminum, is contained in a bath below the mold, with the mold then being immersed into the cooling bath for effecting a substantially large temperature gradient in the melt for enhancing directional solidification.

In a typical directional solidification casting furnace, solid superalloy known as a charge is initially placed inside a melting crucible surrounded by a suitable heater, such as an induction heater, which melts the charge to form the liquid melt with suitable superheat. The mold is initially positioned inside a heating chamber within a furnace, which preheats the mold to a suitable elevated temperature. And, the furnace and mold are disposed above a liquid metal cooling bath. These components are typically disposed within a common pressure vessel or housing which makes up the furnace, which is typically evacuated, or filled with a suitable inert gas.

During the process, the melt is poured from the melting crucible into the preheated mold. The mold is then lowered, bottom end first, into the bath for immersion cooling thereof to directionally solidify the melt upwardly inside the mold. Upon completion of melt solidification inside the mold, the mold is removed upwardly from the bath, furnace, and housing. A new charge and mold are placed inside the housing and the process is repeated to cast additional parts.

It is known that in order to obtain unidirectional crystal growth vertically upward, there need be uniform high thermal gradient in the axial (vertical) direction, so that there is a horizontal liquid-solid interface within the mold, with such interface moving vertically upwards as the metal cools. Accordingly, the cooling must occur unidirectionally in the vertical (axial) direction. Heat loss or a thermal gradient in the radial direction (ie. radially outwards of the mold) is undesirable and has a detrimental effect on unidirectional crystal formation with exterior portions of the mold tend to cool prior to interior portions of the mold resulting in a non-planar liquid-solid interface which has a detrimental effect on unidirectional cooling and thus unidirectional crystal growth formation. Any space between the heating chamber for the mold and the level of the liquid metal bath means that a portion of the mold, particularly its exterior, upon being lowered out of the heating chamber for immersion into the bath, will lose heat through radiation quicker than the interior of the so-exposed mold, resulting in an undesirable radial thermal gradient.

Accordingly, to achieve a purely axial (vertical) thermal gradient for unidirectional cooling, it is known to make the liquid metal bath variably positionable so as to be able to position the liquid metal container, and in particular the level of the liquid metal bath, immediately beneath the heating chamber. In such manner there is no space between the heating chamber and the liquid metal bath, and the mold when lowered out of the heating chamber for immersion into the coolant will be immediately thrust into such coolant. Such a furnace, having a liquid metal bath which may be positionable directly under the heating member, is taught in published EPO application 0631832A1 filed Feb, 2, 1993 and assigned to one of the applicants herein, namely ALD Vacuum Technologies Gmbh. In circumstances where the level of the liquid metal coolant is positioned immediately beneath the heating chamber, upon immersion of the mold within the container containing the liquid metal coolant, the level of the liquid metal coolant is caused to rise due to liquid metal within such container being displaced by the immersed mold. Any rise in the level of such molten liquid coolant is highly undesirable, since it will, being in such proximity to the heating chamber, immediately enter the heating chamber, and likely cause extensive damage to such heating chamber and other problems, such as vaporization of liquid metal coolant. Such problems are very acute where the heating chamber employs induction or resistance heating coils, and the liquid metal contacts such heating coils. In such circumstances damage to the heating coils typically results, due to their temperature generally being significantly higher than that of the liquid metal coolant.

To overcome such problems, the prior art practice has been generally to fill the bath container right to the top with liquid metal coolant, so that any excess will not rise into the heating chamber but will instead spill over the upper lip of the bath container and fall onto the floor of the furnace. This has the disadvantage not only of mess and build-up of solidified coolant on the floor of the furnace, but also has the definite disadvantage that liquid metal coolant must always be added to the bath container after each casting in order to conduct the next casting. Otherwise if no additional liquid metal is added to make up for the quantity of liquid metal lost through displacement, if in the next casting operation the bath container is moved so that the level of the remaining liquid metal is immediately beneath the heating chamber, upon immersion the level of the liquid metal coolant, the liquid metal now having room to rise in the bath container since some metal coolant had previously been lost, will then rise and enter the heating chamber, with undesirable and detrimental results.

A known means to overcome the problem of spillage of the liquid metal to the floor of the furnace is to provide a bath container having a spillway which catches and contains liquid metal coolant overflow, as disclosed and depicted in aforementioned published EPO application 0631832A1, namely in FIG. 4 thereof. Unfortunately, although the liquid metal "spillover" is retained by such spillway, it need subsequently be re-added to the bath container prior to the next casting operation. Frequently, such liquid metal has become solidified, which means it needs to be re-heated, and such wastes time and heat energy. More importantly, however, re-adding the "spillover" for each casting operation makes casting of numerous parts in succession time-consuming and inefficient, increasing the cost of each individually cast article. Alternatively, if in order to compensate for spillover, the bath container is made deep enough so that no "spill-over" over the top lip thereof occurs upon immersion of the mold therein, the operator of the furnace is left with two alternatives, neither of which is desirable. The operator may choose to position the level of the molten liquid metal in the bath container immediately below the heating chamber, in which case upon the immersion of the mold therein the level will rise and enter the heating chamber, with the detrimental results mentioned previously. Alternatively, the operator may choose to position the level of liquid metal slightly below the heating chamber, so that only after full immersion of the mold will the level of the liquid metal rise to the lowermost extremities of the heating chamber. Unfortunately, this means that a "space" will initially exist between the coolant bath and the heating chamber, which will cause the non-directional cooling problems discussed earlier.

Accordingly, a need exists for a furnace apparatus for unidirection solidification of superalloys which overcomes the above problems of the prior art.

SUMMARY OF THE INVENTION

In order to overcome the problems of the prior art and provide for an efficient operation of a furnace for unidirectional solidification of superalloys, the present invention, in one of its broad aspects, provides for a furnace apparatus for directional solidification of an article from a melt, comprising a housing;

a heating chamber within said housing, adapted when activated to pre-heat a mold member to allow said mold member to receive said melt and to maintain said melt in liquid state in said mold member;

a crucible member situated beneath said heating chamber, for containing a liquid metal bath;

means for lowering said mold member from within said heating chamber into said crucible member;

means permitting vertical movement of said crucible member; and automated means, independent from human intervention, for automatically lowering said crucible member upon the level of said liquid metal bath having risen upon said mold member and melt being lowered into said liquid metal bath, to thereby permit said level of liquid metal bath to be maintained in a substantially fixed position immediately beneath said heating chamber during lowering of said mold member into said liquid metal bath.

Advantageously, a furnace of the above configuration allows the level of liquid metal coolant to be continuously maintained immediately beneath the heating chamber, effectively creating a seal at the lowermost end of the heating chamber and eliminating radiation loss therefrom. No "space" need be left between the level of liquid metal coolant and the lowermost extremities of the heating chamber, which would otherwise cause radial thermal cooling gradients, as explained earlier, resulting in loss of unidirectional solidification. Moreover, by eliminating spillover, not only is any mess avoided, but likewise the need to re-add spillover to the bath and the time consuming steps of doing so and having to wait until such "spillover" becomes melted again (if in the interim it has solidified) are overcome.

In addition, the aforementioned feature permits successive castings using the same liquid metal in the bath, without having to stop the operation after each casting operation to make up for spillover. As a result, numerous successive castings can be more quickly carried out than was heretofore the case.

In one embodiment of the furnace apparatus of the present invention, the automated means for automatically lowering the crucible member comprises a detection means for indicating if the level of the liquid metal bath, when the mold member is immersed therein, has risen above a predefined point relative to the heating chamber, and subsequently lowering the crucible member upon the detection means indicating the level of the bath has risen above such point.

As more particularly described herein, the detection means may comprise an electrically-conductive sensor, and more particularly a sensor of the type wherein an electrical circuit is closed upon electrodes from the sensor contacting the rising, electrically-conductive liquid metal coolant.

In an alternative embodiment, instead of employing a sensor, the automated means comprises making use of a known displacement relationship between the distance the mold member is lowered into the liquid metal bath, and the distance which the liquid metal bath correspondingly rises due to displacement of liquid metal within the liquid metal bath, and means for automatically lowering the crucible member into such bath in accordance with said known relationship so as to maintain the level of such liquid metal bath relatively constant.

The present invention further provides a method for the directed solidification of molten metal superalloy utilizing the liquid metal bath furnace apparatus described above, such method comprising:

preheating a mold in a heating chamber directly above a crucible containing a bath of liquid metal coolant;

pouring the molten metal superalloy into the mold;

positioning the liquid metal bath, in particular, the level of the liquid metal in the liquid metal bath, immediately beneath the heating chamber;

lowering the mold into the liquid metal bath; and lowering the crucible containing the liquid metal bath to prevent substantial rise of the level of the liquid metal bath relative to the heating chamber upon the mold being lowered into the bath. In using directional solidification, not infrequently the mold, being typically of a refractive ceramic material and being brittle and relatively fragile, will during the initial melt-pouring process into the preheated mold, break or crack, or alternatively, the melt when poured into the mold will spill over, with the result that all such materials, including any broken mold, would typically fall through the heating chamber downwardly into the cooling bath. Undesirable contamination of the bath results which must be remedied prior to the next molding operation. Accordingly, to protect the cooling bath and mold furnace (which may, due to splashing from mold debris, become damaged) from contamination in the event of mold failure, the apparatus of the present invention is particularly suited for further interposing a catch basin or receptacle between the heating chamber and the crucible member for catching mold debris. The means permitting vertical movement of the crucible member is adapted to move the crucible member and liquid metal bath from a lowered position beneath the basin when the basin member is in an interposed position between the heating chamber and the crucible member, to a raised position immediately beneath the heating chamber when the basin is removed from its interposed position, Likewise, the method of the present invention, providing as it does for a moveable bath, is likewise easily adaptable to including such further features. In partiular, the method of the present invention may be further adapted to include locating a basin between the heating chamber and liquid metal bath prior to pouring the melt into the mold to allow capture of mold debris in the event of breakage or leakage of the mold, and after pouring the melt into the preheated mold member, removing the basin member and raising the liquid bath so that the level of the liquid metal bath is immediately beneath the heating chamber.

Finally, due to the advantages attained in unidirectional solidification which is accomplished by being able to retain the liquid metal bath in close proximity to the heating chamber during immersion of the mold thereon, the invention further comprises an article formed by the method of directional solidification set out above.

BRIEF DESCRIPTION OF THE DRAWINGS

The following drawings show particular embodiments of the present invention in which.

DETAILED DESCRIPTION OF THE INVENTION

Figure 1A:
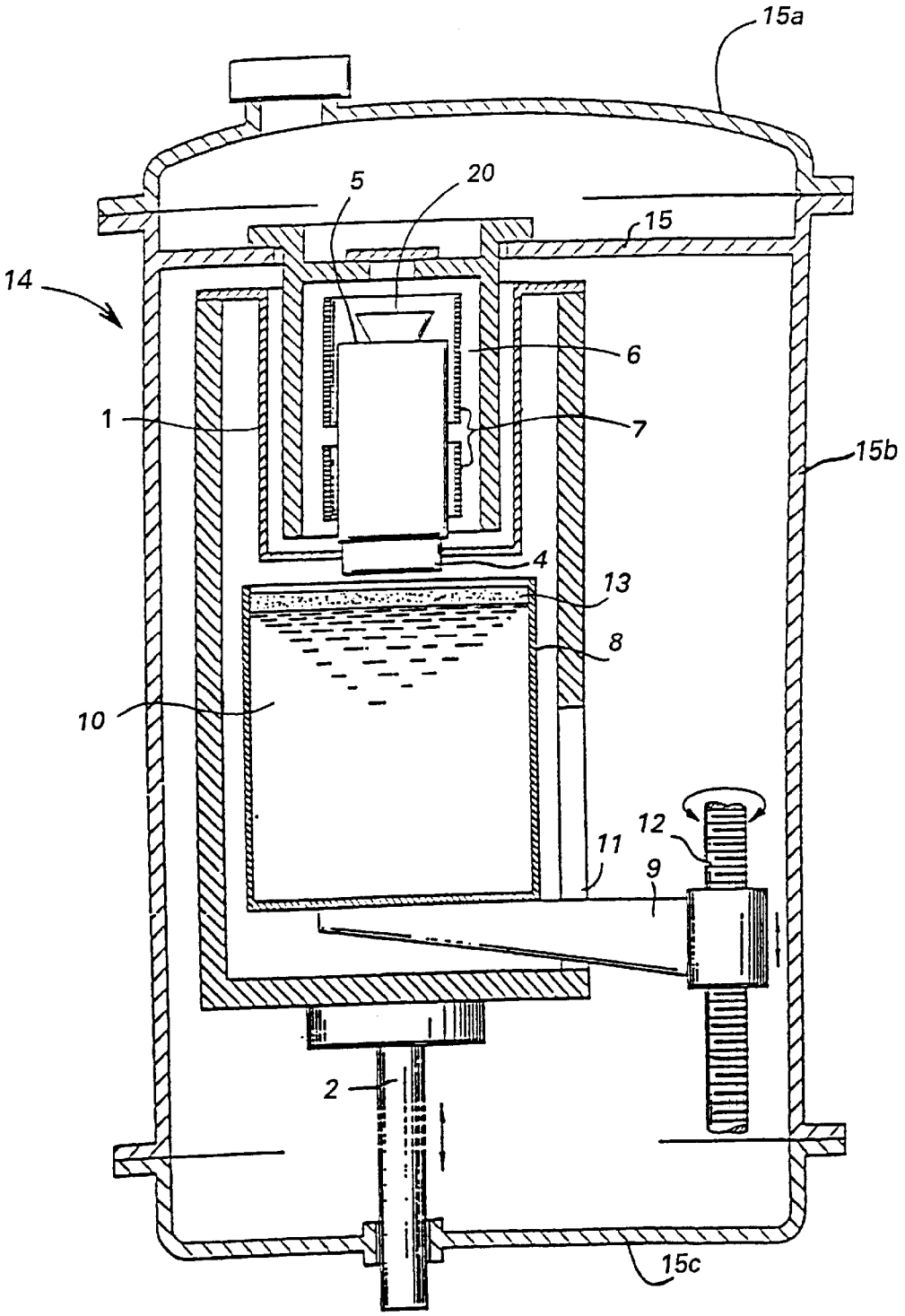
FIG.1A(PRIOR ART)
FIG. 1A is a side cross-sectional view of a directional solidification furnace of the prior art, having both means for lowering the mold into a liquid metal bath, and means for positioning molten metal in a bath container immediately below a heating chamber. Such figure shows the mold about to be immersed in the bath.

FIGS. 1A & B show two views of a directional solidification furnace 14 of the prior art, during two separate stages of the directional solidification casting process. Such furnace 14 typically comprises a housing 15 for conducting the casting process under a vacuum, in the example shown comprising three sections 15*a,* 15*b* and 15*c* respectively.

A heating chamber 6 is provided, having induction heating coils 7 adapted to pre-heat a mold 5 placed therein. Mold 5, in which the molten superalloy is placed for subsequent directional solidification casting, is adapted to receive a pour of molten superalloy through aperture 20. An elevator chamber 1, which may be moved up and down by piston 2, may support a cooling plate 4 on which mold 5 sits.

Figure 1B:
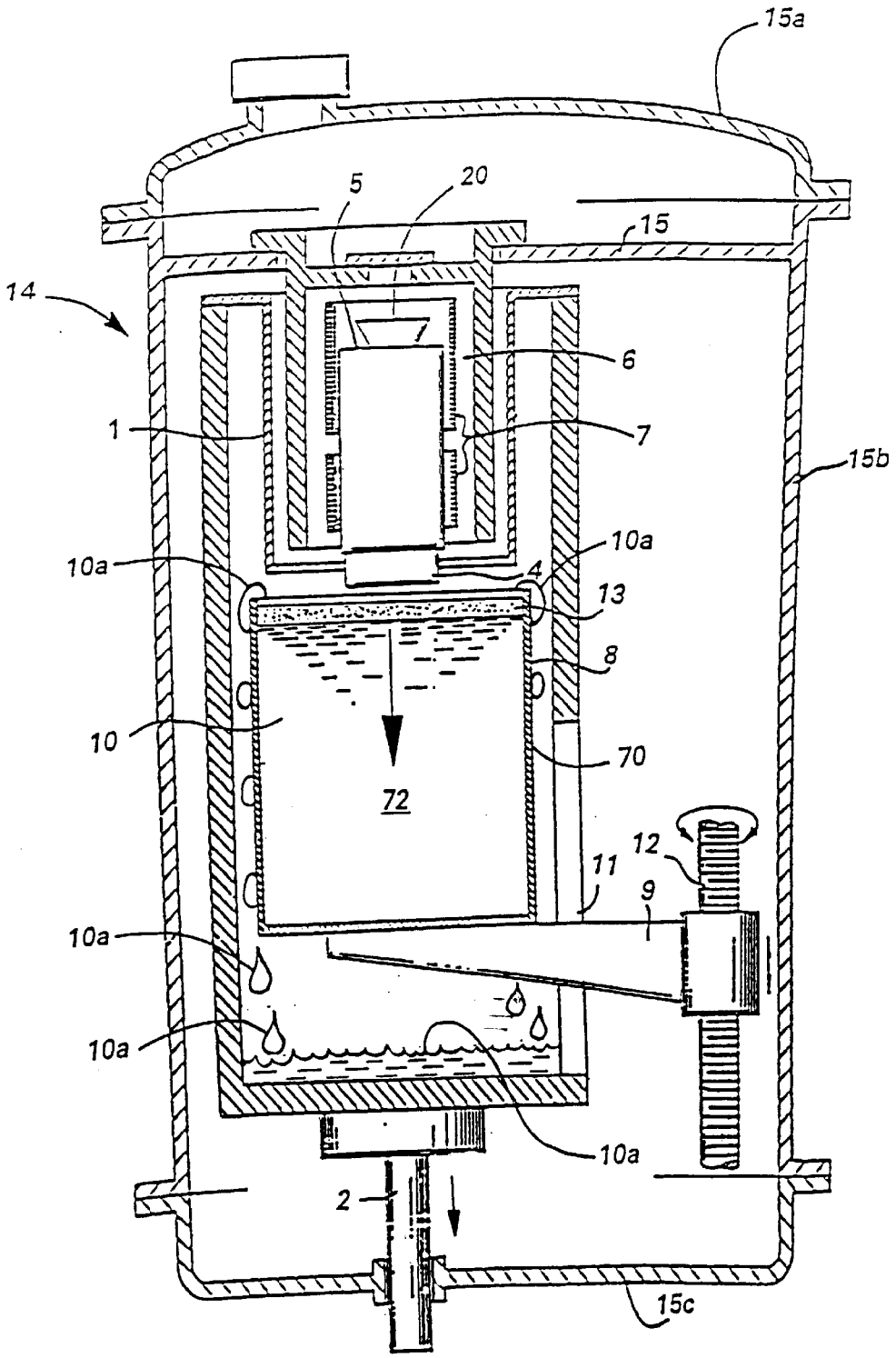
FIG.1B(PRIOR ART)
FIG. 1B is a side cross-sectional view of the directional solidification furnace of the prior art shown in FIG. 1A, showing the mold in the process of being immersed in the liquid metal bath.

A liquid metal container 8, containing a liquid metal quenching bath 10, typically comprised of molten tin or aluminum, adapted to have the mold 5 immersed therein to quench such mold, is mounted on a boom arm 9. By means of threaded rod 12, the liquid metal bath 10 is verticallly positionable so as to allow location of such bath 10, and in particular, the liquid metal 10 therein, beneath heating chamber 6, as shown in FIGS. 1A & 1B. The boom arm 9 is permitted to move upward by virtue of aperture 11 in elevator chamber 1 until quenching bath 10 is situated under heating chamber 6. The bath 10 may have a thermal insulative layer 13 which is penetrable by the mold 5 when lowered into bath 10.

Once container 8 and liquid metal bath 10 is positioned under heating chamber 6 as shown in FIG. 1A, in order to conduct directional solidification of the superalloy present within mold 5, elevator chamber 1 is lowered by slidable piston 2, as shown in FIG. 1B, causing mold 5 and cooling plate 4 to be immersed in cooling bath 10, thereby commencing the directional solidification of the mold 5, with progressive cooling of the mold from bottom to top occurring as mold 5 is gradually immersed in bath 10.

To avoid problems of radial thermal gradients within the mold 5 during the cooling process, the bath container 8 is typically filled with molten metal 10 right up to its uppermost edges, and subsequently the bath container 8 and molten metal bath 10 positioned immediately beneath heating chamber 8 to effectively seal the chamber 8, thereby reducing radiation heat loss via the bottom of the heating chamber 8 (ref. FIG. 1A).

Disadvantageously, however, when piston 2 is lowered so as to immerse the mold 5 in cooling bath 10, as shown in FIG. 1B, due to displacement of molten liquid metal 10 when mold 5 is immersed therein, a quantity of liquid metal coolant 10*a* will spillover onto the floor of the furnace, as shown in FIG. 1B. In order to conduct a subsequent casting operation, the bath container 8 will have to be refilled with the spillover, or with a quantity of metal equal to the spillover, in order to "top up" the bath container 8. This is highly unsatisfactory, for reasons given under Background.

Accordingly, to overcome these problems, the present invention shown in FIGS. 2–6 provides a directional solidification casting furnace 30, comprising a cylindrical housing 32 composed of three separable sections, namely an upper section 32*a,* a middle section 32*b,* and a lower section 32*c.* The cylindrical closed housing 32, typically of steel, creates an atmospheric seal which permits the heating, pouring, casting and directional solidification of a superalloy melt 40 to be carried out under near total vacuum conditions, or alternatively, in presence of an inert gas, to thereby avoid oxidation of some of the trace metals present in the superalloy melt 40 which would otherwise occur if the processes of the present invention were to be carried out in air under normal atmospheric conditions. Accordingly, for the purpose of creating a vacuum within casting furnace 30 a vacuum pump 42 is provided. Sighting view ports 20*a* and 20*b* are provided in the locations shown in FIGS. 2–6, should viewing of the process be desired at any time.

Suitably disposed inside the housing 32 is a heating chamber 44 which acts as a mold furnace to preheat a mold 46, prior to receiving the liquid melt 40 and also for times thereafter. Such heating chamber may take any conventional form. In the exemplary embodiment illustrated, the heating chamber 44 is a multi-zone furnace having three vertically aligned zones each having a respective, independently powered zone heater, which may comprise resistance heating elements 48*a, b,* and *c.* Surrounding the zone heaters 48*a, b* and *c* is an insulating chamber or box 49 of suitable heat insulating material for containing the heat from zone heaters 48*a, b* and *c* inside the heating chamber 44. The heating chamber 44 is open at its top and bottom.

The mold 46 is initially disposed inside the heating chamber 44 at the beginning of the casting process, and is formed of a suitable refractory or ceramic material for receiving the superalloy melt 40.

A first or upper elevator 50 is preferably disposed above the upper housing 32*a,* and extends in part into the housing 32 for selectively lowering and raising the mold 46 into and out of the heating chamber 44 and housing 32 via port 92. The upper elevator 50 may take any conventional form for transferring in turn individual molds 46 into position in the heating chamber 44 and for subsequent vertical travel during the casting process as hereinafter described.

The melt 40 is initially provided in the form of a solid charge which may be suitably delivered into housing 32 through an access port 52 in the top housing member 32*a,* and initially deposited in a crucible 60. The crucible 60 may take any conventional form, and is typically formed of a suitable refractory material surrounded by an induction heater 62. The induction heater 62 is independently powered for melting the solid superalloy charge inside crucible 60 to create the liquid superalloy melt 40.

The melt material 40 may be a nickel-based or cobalt-based superalloy for casting high-temperature strength gas turbine engine rotor blades and stator vanes, for example. Correspondingly, the mold 46 may take any conventional form for casting suitable components such as the blades and vanes, and is specifically configured for promoting directional solidification of the melt 40 into a single crystal component upon solidification of the melt 46 therein. The mold 46, therefore, typically has a complex shape and varying outer configuration or profile and may be arranged simply, or in multiple units or gangs within a suitably sized heating chamber 44. The mold 46 may further have at its base a cooling plate 90, typically of a highly thermally conductive material, which assists in ensuring cooling of the mold occurs at the lowest point, and which therefore assists in the directional solidification process.

The crucible 60 is initially disposed inside the housing 32 adjacent the heating chamber 44, and is attached to a suitable carriage 65 for transporting the crucible 60 to the top of the heating chamber 44 and tilting the crucible 60 to pour the melt 40 into the top of the mold 46 inside the heating chamber 44. The carriage 65 may take any conventional form for transporting the crucible 60 back and forth to the heating chamber 44 for allowing repeated recharging of the crucible 60 with a new melt charge 40 and filing successive molds 46 in sequence operation.

An open crucible or bath container 70 of a suitable refractory material, is disposed vertically below the heating chamber 44. Such crucible 70 allows for immersion cooling of the mold 46 as hereinafter more fully described to directionally solidify the melt 40 within mold 46 when such mold 46 is lowered into bath 70. The bath 70 contains a suitable liquid metal coolant 72, which may be molten tin or aluminum for example, having a lower melting point than the superalloy melt 40, which is used to cool the mold 46. A suitable bath heater comprised of resistive heater elements 74 may surround the bath 70 for melting and maintaining the coolant 72 at a suitable temperature useful for cooling the mold 46 containing the superheated melt 40.

Figure 2:
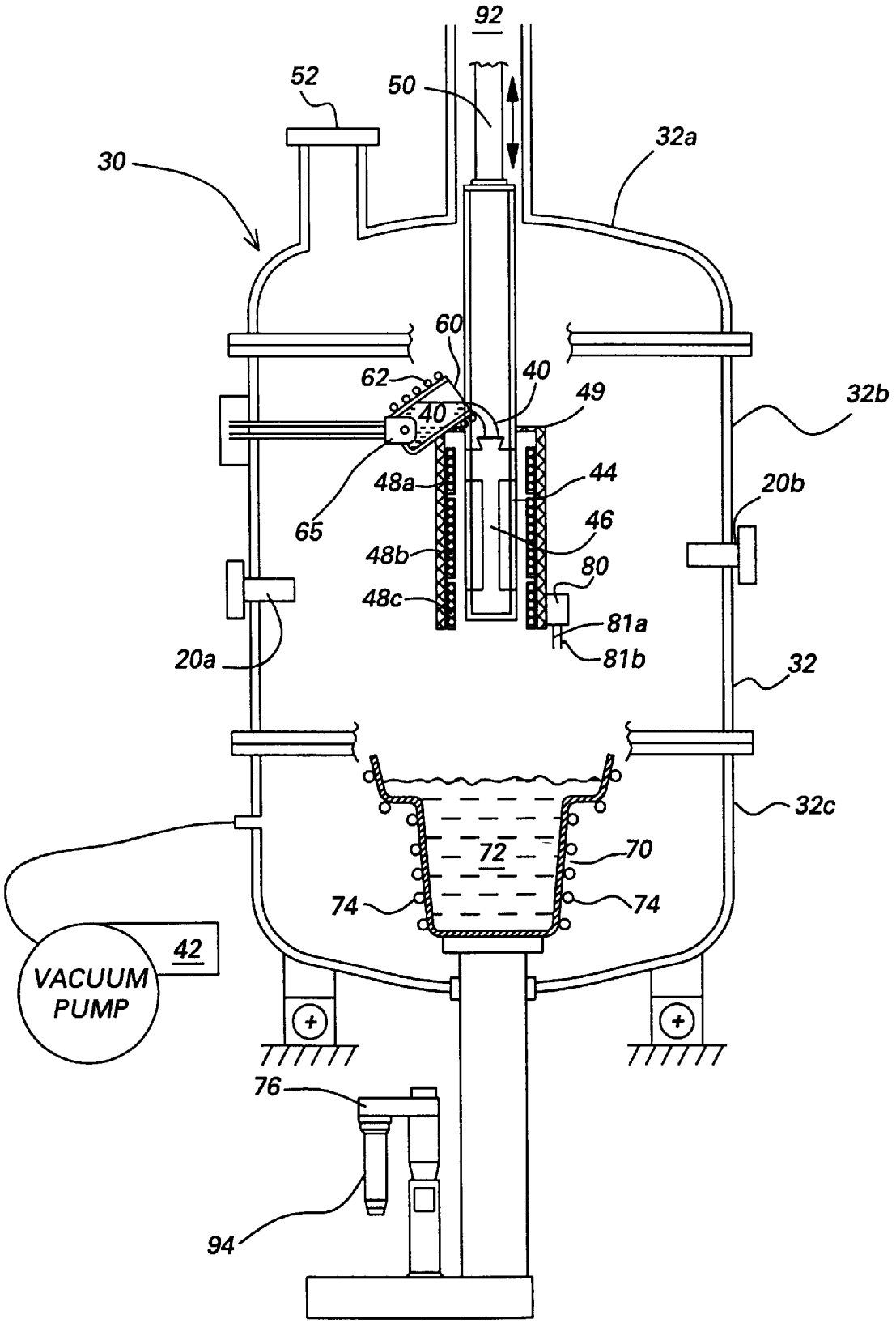
FIG. 2 is a side cross-sectional view of a directional solidification furnace of the present invention, showing the liquid metal bath raised so as to position it immediately beneath the heating chamber.
Figure 3:
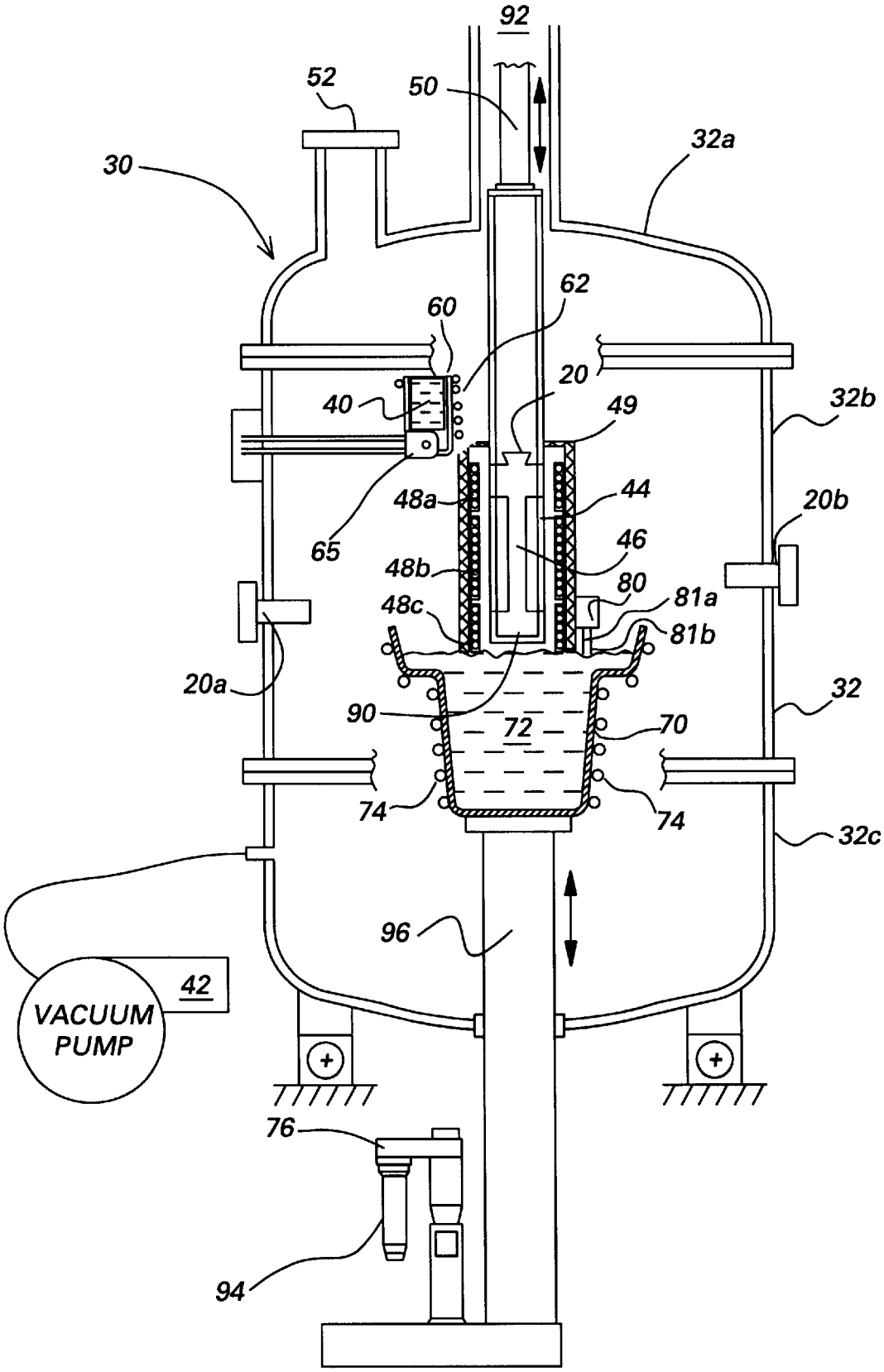
FIG. 3 is a side cross-sectional view of the directional solidification furnace of FIG. 2, showing the mold partially immersed in the liquid metal bath, and the liquid metal bath correspondingly lowered in accordance with the method of the present invention so as to maintain the liquid metal bath level in a fixed position immediately beneath the heating chamber.

In the exemplary embodiment illustrated in FIG. 2, the bath 70 is moved vertically by a second (lower) elevator 76 which is disposed vertically below the housing 32*c* and extends in part through the bottom of the housing 32*c* and upwardly to support the bath 70. The second elevator 76 may take any conventional form for selectively raising and lowering the bath 70 into and out of position below the heating chamber 44, but in the preferred embodiment may be activated electrically and comprise an electrically-driven hydraulic pump 94 which supplies hydraulic oil under pressure to a hydraulic ram/piston 96 which is used to raise/lower the bath 75.

Importantly, a sensor 80 is provided. Such sensor 80 may be fixedly attached to the heating chamber 44 or to anywhere on the furnace housing 32, and operates in conjunction with the lower elevator 76 in the manner hereinafter described, to permit the level of liquid metal 72 to be maintained in a substantially fixed position immediately beneath the heating chamber 44 during lowering of the mold 46 into the coolant 72. Such sensor may be anyone of the commercially available sensors for detecting the level of a liquid, but in one embodiment is of the type having two electrodes 81*a,* 81*b,* which create a closed electrical circuit when contacted by the liquid metal coolant, where the coolant is highly electrically conductive, such as aluminum. The electrodes 81*a,* 81*b* of the sensor 80 are positioned to contact the coolant 72 at a position at or just slightly above the maximum desired level of the coolant. Upon the electrodes 81*a,* 81*b* being contacted by the coolant, an electrical signal is provided to lower elevator 76 to cause it to lower the melt bath 70, thereby lowering the level of the coolant 72. As soon as the electrical circuit is opened by loss of electrical connection between the electrodes 81*a,* 81*b* due to the lowering of the coolant 72, the electric signal to the elevator 76 is interrupted, with the result that the bath 70 and coolant 72 ceases to continue to be lowered. The process will be iteratively repeated as the mold 46 is gradually lowered into coolant 72, with each lowering of the mold causing a resultant increase in the level of the coolant, which will be detected by the electrodes 81*a,* 81*b,* when the electrical circuit is closed by the rising coolant 72, resulting in an electrical signal being sent to the lower elevator 76 to cause it to lower the bath 70 and cool at 72 therein.

The method of the present invention for directional solidification casting of an article in one of its broadest aspects will now be described.

An empty mold 46 is lowered by first elevator 50 into position inside the heating chamber 44 and is preheated to ready the mold 46 to receive the melt 40. Such preheating of mold 46 avoids thermal shock to the mold 46 when it receives melt 40. A solid billet of superalloy is lowered through port 52 into crucible 60, and heated so as to create a liquefied melt 40.

The melt 40 is then moved via carriage 65 over heating chamber 44, and poured into preheated mold 46, where it may optionally continue to have heat supplied to it by heating chamber 44, if necessary, to maintain the melt 40 in a liquid state prior to or during the directional solidification process.

Bath 70 which contains liquid metal coolant 72 is then raised by lower elevator 76, so as to position the level of the liquid metal coolant 72 in bath 70 immediately below heating chamber 44. By positioning the liquid metal coolant 72 at such position it is possible to substantially reduce or eliminate any space between the bottom of the heating chamber 44 and the level of the liquid metal bath, which would otherwise allow heat from the mold 46 to be radially emitted prior to the mold 46 being immersed in the coolant 72. Indeed, the bath 70 may be raised and sensor 80 positioned so that the level of liquid metal coolant 72 therein is maintained so as to actually contact the lowest portion of the heating chamber and/or the cooling plate 90 on the base of mold 46, thereby eliminating or reducing as much as possible any thermal heat loss in a radial direction from within the heating chamber 44 and from the mold 46.

Upon bath 70 and coolant 72 being raised to so that coolant 72 is at the 10 desired level, mold 46 is gradually lowered by upper elevator means 50 downwardly from within the heating chamber 44 into coolant 72 to start the directional solidification process of the melt 40 within the mold 46. During this process the directional solidification starts at the bottom of the mold 46 and propagates vertically upwardly therein as the mold 46 is gradually lowered into coolant 72. This obtains a substantially single crystal solid which grows in a desired unidirectional direction vertically upward.

Importantly, as the mold 46 is gradually immersed in coolant 72, the level of coolant 72 rises, such rise in level being detected by the sensor 80. After a signal from sensor 80, lower elevator 76 is then immediately activated to cause hydraulic ram 88 to be lowered, thereby lowering bath 70 so as to maintain the level of coolant 72 at the desired height beneath the heating chamber 44. If bath 70 was not lowered, the level of coolant 72 would rise and either spill over from bath container 70, or rise into heating chamber 44, thereby damaging lower heating resistance elements 48*c,* and possibly 48*b*. As may be clearly seen from FIGS. 3 and 6, due to the immersion of the mold 46 in coolant 72 in accordance with the method of the present invention, hydraulic ram 96 operated by lower elevator 76 has lowered bath 70 a distance 'a' to thereby maintain the level of the coolant 72 at the same level as that prior to immersion, namely immediately below heating chamber 44 as shown in FIGS. 2 and 5.

Upon entire immersion of the mold 46 in coolant 72, the upper elevator 50 is then reversed for removing upwardly the mold 46 from bath 70 and heating chamber 44, and outwardly through the upper housing 32*a* via exit port 92, for replacement with the next empty mold 46 for repetition of the casting process.

Of note, since the bath 70 and coolant 72 are disposed directly below heating chamber 44 during the melt-pouring process (see FIG. 4), failure or breakage of the mold 46 at this step would contaminate coolant 72 in bath 70 with the resulting mold debris and poured melt 40. Furthermore, the fallen mold debris and poured melt may cause the coolant 70 to splash upwardly into one or more of the core heaters 48*a, b,* or *c* causing undesirable damage thereto.

Figure 4:
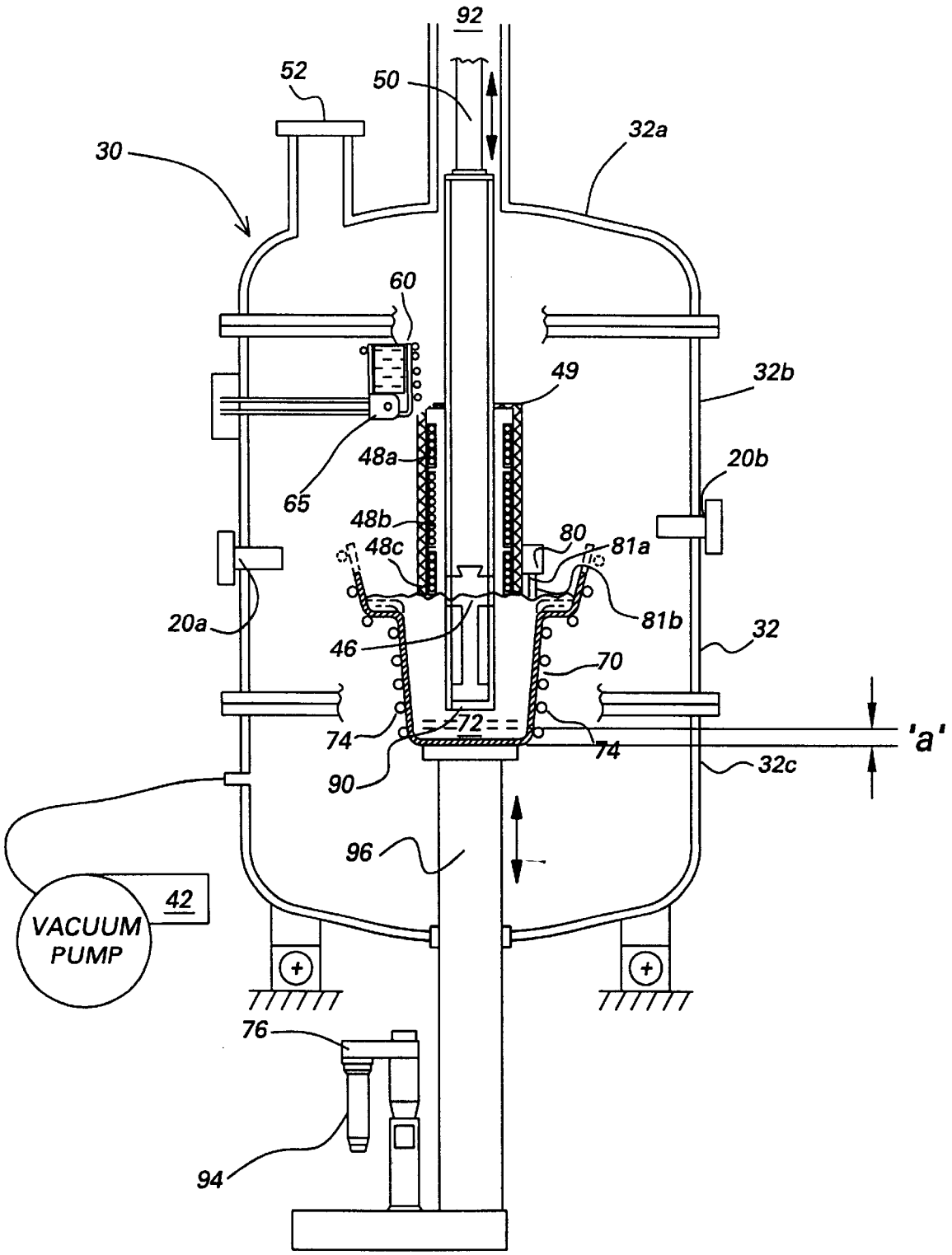
FIG. 4 is a side cross-sectional view of the same directional solidification furnace of the present invention, shown during the melt-pour stage, showing the further utilization of a receptacle to receive mold debris, wherein such receptacle is in the extended position.
Figure 5:
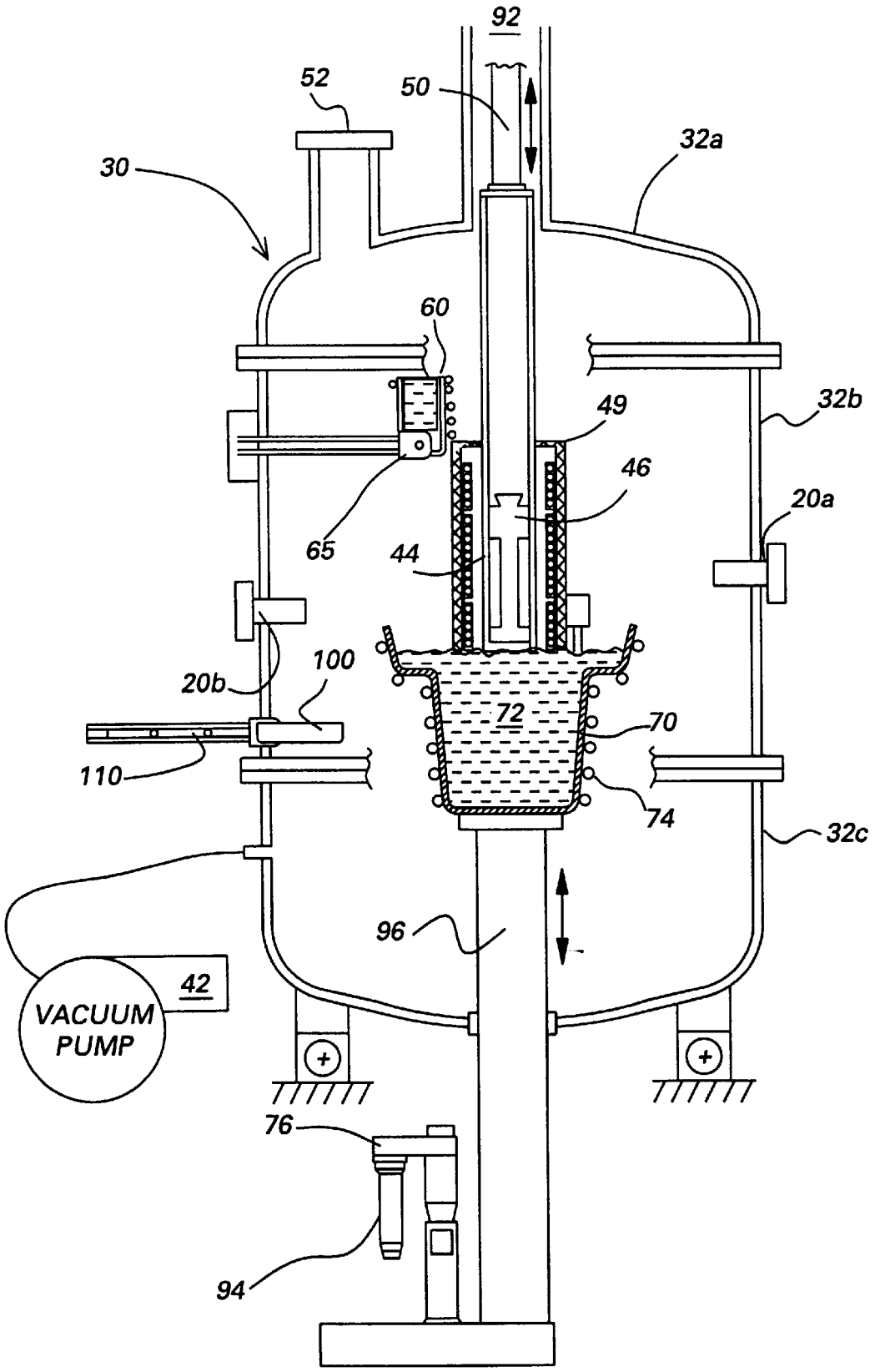
FIG. 5 shows the directional solidification furnace of FIG. 4, with the receptacle to receive mold debris in the retracted position.
Figure 6:
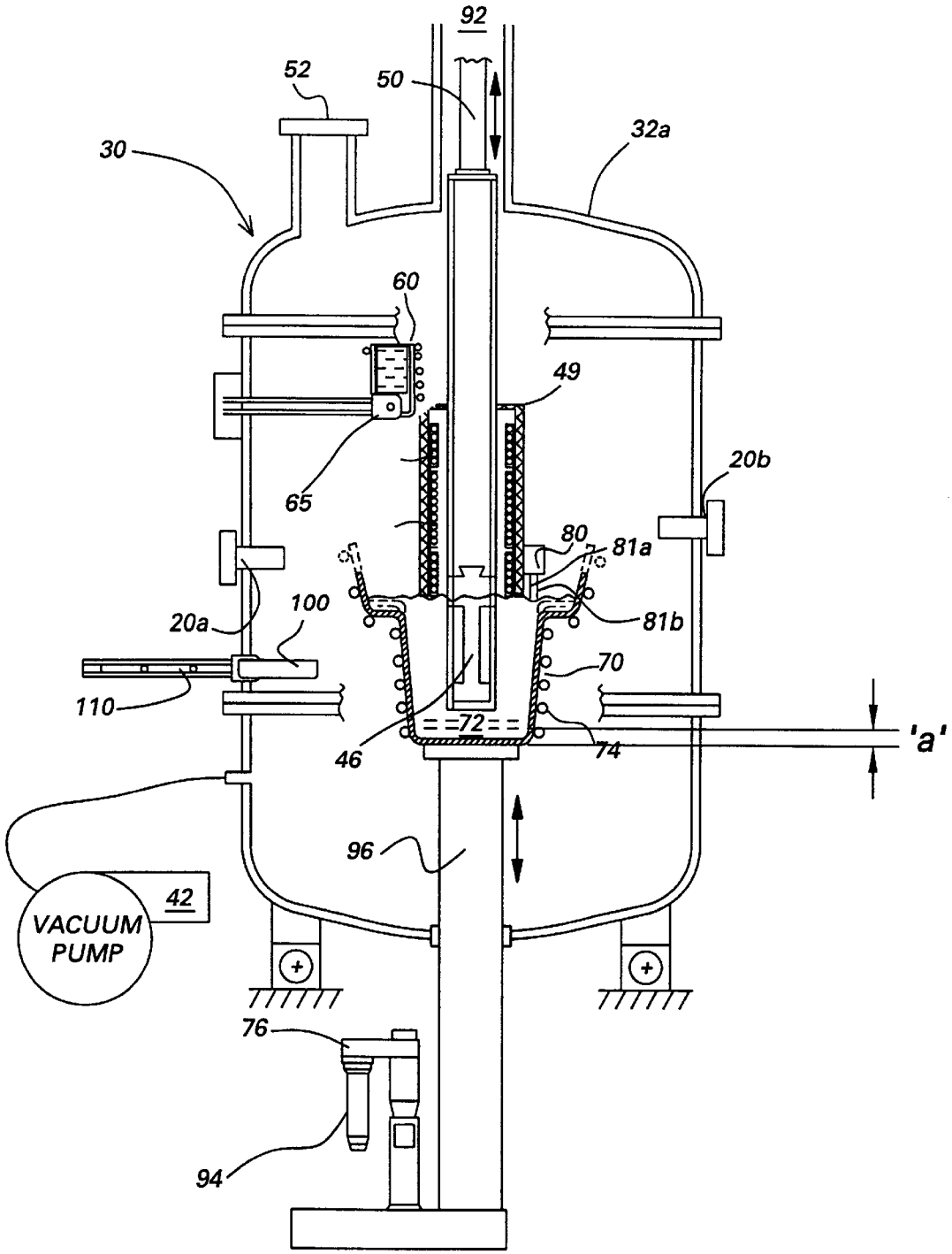
FIG. 6 shows a directional solidification furnace of FIG. 4, showing the mold partially immersed in the liquid metal bath, and the liquid metal bath level correspondingly lowered in accordance with the method of the present invention to compensate for the increase in level of the liquid metal bath, further showing the receptacle in the retracted position.

Accordingly, as an added feature to the apparatus and method of the present invention, an empty receptacle or basin 100, as shown in FIGS. 4–6, is provided, removably disposed between heating chamber 44 and bath 70. A suitable actuator 110 is coupled to basin 100 for selectively deploying the basin 100 into position under heating chamber 44 during the melt-pour step as shown in FIG. 4, and for withdrawing and storing the basin 100 away from the heating chamber 44 at a suitable location within the housing 32 after completion of the melt pour step, as shown in FIGS. 5 & 6.

The basin 100 is preferably comprises an open container sized to capture substantially all mold debris and melt 40 in the event of breakage of mold 46, to prevent any contamination of coolant 72 in bath 70. It is further of a suitable refractory material that will not be damaged by falling melt.

The method of the present invention wherein a catch basin is further utilized will now be described, with reference to FIGS. 4–6. Commencing with the mold heating and pouring step, the mold 46 situate in heating chamber 44 is preheated to ready it to receive the liquid melt 40, which is heated in crucible 60. Bath 70 is lowered by second elevator 76, and catch basin 100 is extended by actuator 110 to position it immediately beneath mold 46 within heating chamber 44. Liquid melt 40 is moved by carriage 65 above mold aperture 20 and poured into mold 46, as shown in FIG. 4. Catch basin 100 is then removed by actuator 110 from its extended position beneath mold 46 to a stowed position away from heating chamber 44, and bath 70 is then raised to a position which the sensor 80 no longer permits upward travel of hydraulic piston 96, namely to a position wherein the level of the liquid metal coolant 72 in bath 70 is immediately below heating chamber 44, as shown in FIG. 5.

Thereafter the mold 46 is lowered into coolant 72 by upper elevator 50. As the level of the coolant 72 rises due to immersion of mold 46 therein, such rise in level is detected by sensor 80, and the lower elevator 76 is activated so as to cause the bath 70 to be lowered, thereby maintaining the level of coolant 72 at a consistent desired level.

It is contemplated that the method of the present invention, namely while lowering the mold 46 into the coolant 72 lowering the bath 70 so as to maintain the coolant level at a fixed desired level, may be practiced without the use of a sensor 80. In particular, there is a direct proportionate relationship between the distance the mold 46 is lowered into the liquid coolant 72, and the rise in the level of the coolant 72 that results, such relationship depending on the surface area of the mold as a function of its height and the total volume of the bath container as a function of its height. Accordingly, such relationship may be calculated mathematically, or established empirically through experimental trial runs wherein the mold is immersed in the bath and the relationship established between the amount of lowering of the upper elevator and the resultant increase in the level of the coolant level. Upon establishing such relation, the lower elevator 76 may be operated to lower the bath 70 commensurate with the lowering of the upper elevator 50 at the respective proportionate rate which ensures the level of the coolant 72 relative to the heating chamber 44 remains at a fixed desired location.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A furnace apparatus for the directional solidification of an article from a melt, comprising:

a housing;

a heating chamber within said housing, adapted when activated to preheat a mold to allow said mold to receive said melt and to maintain said melt in liquid state in said mold;

a crucible member situated beneath said heating chamber, for containing a liquid metal bath;

means for lowering said mold from within said heating chamber into said crucible member;

means permitting vertical movement of said crucible member; and automated means for automatically lowering said crucible member upon the level of said liquid metal bath having risen, to thereby permit said level of liquid metal bath to be maintained in a substantially fixed position immediately beneath said heating chamber during lowering of said mold into said liquid metal bath, said automated means for automatically lowering said crucible comprising a detection means for indicating if the level of said liquid metal bath, when said mold is immersed in said liquid metal bath, has risen above a predefined point relative to said heating chamber, and a means for lowering said crucible member upon said detection means indicating the level of said liquid metal bath has risen.

2. The furnace apparatus as claimed in claim 1, further comprising: a basin member removably disposed between said heating chamber and said crucible member for catching mold debris and said melt in the event of breakage or leakage of said mold; said means permitting vertical movement of said crucible member adapted to move said crucible member and said liquid metal bath therein from a lowered position beneath said basin member when said basin member is in an interposed position between said heating chamber and said crucible member, to a raised position immediately beneath said heating chamber when said basin member is removed from said interposed position.

3. The furnace apparatus as claimed in claim 1, wherein said liquid metal bath is electrically conductive, and said detection means comprises an electrically conductive sensor.

4. The furnace apparatus in claim 3, said electrically conductive sensor indicating if the level of said liquid metal bath has risen above a predefined point upon said electronically conductive liquid metal contacting said sensor.

5. A method for the directional solidification of an article from a melt using a liquid metal bath, comprising:

preheating a mold in a heating chamber above a crucible, said crucible containing a bath of liquid metal coolant;

pouring said melt into said preheated mold;

positioning said crucible such that the level of said liquid metal in said crucible is immediately beneath said heating chamber;

lowering said mold and melt into said liquid metal bath;

detecting the rise of liquid metal coolant due to displacement by said mold as it is lowered into said liquid metal bath;

transmitting a detection signal of said rise of liquid metal coolant due to displacement; and lowering said crucible member containing said liquid metal bath upon receipt of said detection signal, to prevent substantial rise of the level of said liquid metal bath relative to said heating chamber upon said mold being lowered into said bath.

6. The method for the directional solidification of an article as claimed in claim 5, said method further comprising the following steps:

locating a basin between said heating chamber and said crucible containing said bath, prior to pouring said melt, to allow capture of mold debris and said melt in the event of breakage or leakage of said mold;

after pouring said melt into said preheated mold, removing said basin member and raising said crucible member so that the level of said liquid metal bath is immediately beneath said heating chamber.

7. The method for directional solidification of an article as claimed in claim 6, said step of raising said crucible member further comprising raising said crucible member so that the level of said liquid metal bath contacts lowermost extremities of said heating chamber.

8. The method for directional solidification of an article as claimed in claim 7, said step of raising said crucible member so that the level of said bath contacts lowermost extremities of said heating chamber further comprises immersing the lowermost extremities of said heating chamber into said liquid metal bath so as to substantially block escape of heat from lowermost extremities of said heating chamber.

* * * * *